US007416826B2

(12) United States Patent
Nakamura et al.

(10) Patent No.: US 7,416,826 B2
(45) Date of Patent: Aug. 26, 2008

(54) COLOR TONER FOR ELECTROPHOTOGRAPHY AND COLOR TONER SET FOR ELECTROPHOTOGRAPHY USING THE SAME, COLOR DEVELOPER FOR ELECTROPHOTOGRAPHY, METHOD FOR FORMING COLOR IMAGE, AND APPARATUS FOR FORMING COLOR IMAGE

(75) Inventors: Yasushige Nakamura, Kawasaki (JP); Tomoaki Tanaka, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 738 days.

(21) Appl. No.: 10/272,009

(22) Filed: Oct. 17, 2002

(65) Prior Publication Data

US 2003/0186148 A1 Oct. 2, 2003

(30) Foreign Application Priority Data

Mar. 19, 2002 (JP) ..... 2002-077037

(51) Int. Cl.
*G03G 9/09* (2006.01)
*G03G 9/087* (2006.01)

(52) U.S. Cl. ..... 430/107.1; 430/45.51; 430/45.55; 430/108.1; 430/108.21; 430/111.4; 399/223; 399/336

(58) Field of Classification Search ..... 430/107.1, 430/45, 108.21, 108.1, 110.4, 111.4, 108.8, 430/45.5, 45.51, 45.55; 399/223, 336
See application file for complete search history.

(56) References Cited

U.S. PATENT DOCUMENTS

| | | | | |
|---|---|---|---|---|
| 4,699,863 | A | 10/1987 | Sawatari et al. | |
| 5,364,722 | A | 11/1994 | Tanikawa et al. | |
| 5,476,742 | A | 12/1995 | Tavernier et al. | |
| 5,707,771 | A * | 1/1998 | Matsunaga | 430/111.4 |
| 5,912,099 | A * | 6/1999 | Kanbayashi et al. | 430/108.21 |
| 6,074,794 | A * | 6/2000 | Fushimi et al. | 430/109.2 |
| 6,136,488 | A | 10/2000 | Kushino et al. | |
| 6,150,062 | A * | 11/2000 | Sugizaki et al. | 430/45 |
| 6,180,298 | B1 * | 1/2001 | Kuroda et al. | 430/45 |
| 6,633,740 | B2 * | 10/2003 | Estabrooks | 399/384 |
| 6,641,965 | B2 * | 11/2003 | Nakamura et al. | 430/107.1 |
| 2002/0037466 | A1 * | 3/2002 | Kanbayashi et al. | 430/108.23 |

FOREIGN PATENT DOCUMENTS

| | | | |
|---|---|---|---|
| EP | 0 622 640 | A2 | 7/1995 |
| JP | 58-102247 | | 6/1983 |
| JP | 58-102248 | | 6/1983 |
| JP | 60-57857 | | 4/1985 |
| JP | 60-57858 | | 4/1985 |
| JP | 60-63545 | | 4/1985 |
| JP | 60-63546 | | 4/1985 |
| JP | 60-131544 | | 7/1985 |
| JP | 60-133460 | | 7/1985 |
| JP | 61-132959 | | 6/1986 |
| JP | 5-197192 | | 8/1993 |
| JP | 5-249734 | | 9/1993 |
| JP | 5-297629 | | 11/1993 |
| JP | 5-346678 | | 12/1993 |
| JP | 5-346684 | | 12/1993 |
| JP | 6-89044 | | 3/1994 |
| JP | 6-282102 | | 10/1994 |
| JP | 6-348056 | | 12/1994 |
| JP | 7-191492 | | 7/1995 |
| JP | 7-234537 | | 9/1995 |
| JP | 8-334919 | | 12/1996 |
| JP | 10-39535 | | 2/1998 |
| JP | 11-38666 | | 2/1999 |
| JP | 11-65167 | | 3/1999 |
| JP | 11-125929 | | 5/1999 |
| JP | 11-125930 | | 5/1999 |
| JP | 2000-35689 | | 2/2000 |
| JP | 2000-39794 | | 2/2000 |
| JP | 2000-147824 | | 5/2000 |
| JP | 2000-155439 | | 6/2000 |
| JP | 2001-312113 | A | 11/2001 |
| JP | 2002-169336 | * | 6/2002 |

OTHER PUBLICATIONS

Japanese Patent Office partial machine-assisted translation, i.e., claims and examples, of JP 2002-169336 (pub. Jun. 2002).*
American Chemical Society File Registry No. 1047-16-1 on STN, entered STN on Nov. 16, 1984, copyright 2005 ACS on STN.*

* cited by examiner

*Primary Examiner*—Janis L Dote
(74) *Attorney, Agent, or Firm*—Westerman, Hattori, Daniels & Adrian, LLP.

(57) ABSTRACT

A color toner for electrophotography having excellent fixability and void resistance is capable of forming a high-quality image. The color toner for electrophotography comprises a binder resin and is a magenta toner, and used in combination with at least any of yellow toner and cyan toner. The storage modulus ($G'_{100}$) (100° C.) of the binder resin is (1/1.1) to (1/10) times the storage modulus ($G'_{100}$) (100° C.) of a binder resin contained in the yellow toner and the cyan toner. In addition, the color toner for electrophotography comprises a binder resin, C.I. pigment Violet 19, and an infrared absorbent. The color toner is a magenta toner used in combination with at least any of an yellow toner and a cyan toner. The content of the infrared absorbent in the magenta toner is higher than the content of an infrared absorbent in the yellow toner and the cyan toner.

13 Claims, 2 Drawing Sheets

COLOR TONER FOR ELECTROPHOTOGRAPHY AND COLOR TONER SET FOR ELECTROPHOTOGRAPHY USING THE SAME, COLOR DEVELOPER FOR ELECTROPHOTOGRAPHY, METHOD FOR FORMING COLOR IMAGE, AND APPARATUS FOR FORMING COLOR IMAGE

CROSS-REFERENCE TO RELATED APPLICATIONS

This application is based upon and claims priority of Japanese Patent Application No. 2002-077037, filed in Mar. 19, 2002, the contents being incorporated herein by reference.

BACKGROUND OF THE INVENTION

1. Field of the Invention

The present inventiFon particularly relates to a color toner for electrophotography to be preferably used for an electrophotographic method performing flash fixing, an electrostatic recording method, a magnetic recording method, or the like, and a color toner set for electrophotography using the same, a color developer for electrophotography, a method for forming a color image, and an apparatus for forming a color image.

2. Description of the Related Art

In general, for image forming in an electrophotographic system, the following processes are performed: (1) charging of a photoconductor; (2) exposure of the photoconductor to light (forming a latent image); (3) development of the latent image by a toner; (4) transfer of the toner onto a transfer material; (5) fixing of the toner onto the transfer material; and other processes. Examples of a method for fixing the toner transferred onto the transfer material may include: a method in which the toner is fused by application of pressure or heat, or by a combination thereof, and then solidified and fixed; and a method in which the toner is fused by irradiation with an optical energy, and then solidified and fixed. Recently, out of these methods, attention has been focused on oven fixing, flash fixing utilizing a light, or the like, which will not be detrimentally affected through application of pressure or heat, from the viewpoint that the method is capable of forming a fine, high-resolution image.

Namely, in these fixing methods for fixing a toner, the toner is not required to be applied with pressure. This eliminates the problem of offset, or the like, which arises in the case of a fixing roller, or the like. In consequence, these methods advantageously cause less degradation in image resolution (reproducibility) in the fixing step. Further, the toner is not required to be heated by means of a heat source or the like. This eliminates the problem that printing cannot be performed until the heat source (a fixing roller, or the like) will be preheated to a desired temperature upon power-on, or other problems. In consequence, these methods also have an advantage in that printing is possible immediately after power-on. Still further, these methods do not require a high-temperature heat source, and hence are advantageously capable of properly avoiding the temperature rising in the apparatus, or the like. Particularly, the flash fixing method also has the following advantages: even if recording paper is jammed in a fixing unit due to a system malfunction, or in other cases, the recording paper will not burn due to the heat from the heat source; and other advantages.

In general, a color toner has a low light absorption efficiency, resulting in a lower fixability as compared with a black toner. For this reason, a large number of technologies for improving the fixability by adding an infrared absorbent to the toner are proposed in, for example, Japanese Patent Application Laid-Open (JP-A) Nos. 60-63545, 60-63546, 60-57858, 60-57857, 58-102248, 58-102247, 60-131544, 60-133460, and 61-132959, WO 99/13382, JP-A Nos. 2000-147824, 7-191492, 2000-155439, 6-348056, 10-39535, 2000-35689, 11-38666, 11-125930, 11-125928, 11-125929, and 11-65167.

However, in multicolor to full-color image forming, when multicolor toners are simultaneously fixed with the same flash energy, the toners of respective colors may have mutually different fixabilities due to a difference therebetween in type of pigment to be added to each color toner, concentration, absorbance, or the like. For this reason, even if toners are manufactured under generally the same conditions, unfavorably, it is not possible to sufficiently attain both of the fixability and the void resistance in every color toner.

Particularly, a magenta toner tends to be increased in viscosity under the influence of a pigment during toner manufacturing, unfavorably resulting in poorer fixability than that of a cyan toner or a yellow toner. For example, even if toners are manufactured under generally the same conditions, the cyan toner or the yellow toner may show better fixability as compared with the magenta toner.

In this case, if the flash energy for fixing the toner is set to be optimum condition for the cyan toner or the yellow toner, the magenta toner unfavorably shows an insufficient fixability. On the other hand, if the flash energy for fixing the toner is set to be optimum condition for the magenta toner, there occurs an excessive flash energy for the cyan toner and the yellow toner, unfavorably resulting in occurrence of voids in these toners.

Therefore, for ensuring the compatibility between fixability and the void resistance, it is important to reduce the difference in fixability between toners of respective colors as much as possible. JP-A No. 11-141347 discloses that a difference in viscosity between a monochrome toner and a color toner is caused. In this case, however, no mention is made of the problem of fixability between color toners when the magenta toner is used.

SUMMARY OF THE INVENTION

It is therefore an object of the present invention to provide a color toner for electrophotography which is excellent in fixability and void resistance, and is capable of forming a high-quality image and a color toner set for electrophotography using the same, a color developer for electrophotography, a method for forming a color image, and an apparatus for forming a color image.

A first color toner for electrophotography of the present invention contains a binder resin, wherein the color toner is a magenta toner, and used in combination with at least any of a yellow toner and a cyan toner, and the storage modulus ($G'_{100}$) (100° C.) of the binder resin is (1/1.1) to (1/10) times the storage modulus ($G'_{100}$) (100° C.) of a binder resin contained in the yellow toner and the cyan toner.

A second color toner for electrophotography of the present invention contains: a binder resin having a storage modulus ($G'_{100}$) (100° C.) of $9.0\times10^3$ to $4.0\times10^4$ dyn/cm$^2$; and C.I. pigment Violet 19, wherein the color toner is a magenta toner, and used in combination with at least any of a yellow toner and a cyan toner each containing a binder resin with a storage modulus ($G'_{100}$) (100° C.) of $4.4\times10^4$ to $8.0\times10^5$ dyn/cm$^2$.

A third color toner for electrophotography of the present invention contains: a binder resin; and C.I. pigment Violet 19, wherein the color toner is a magenta toner, and is used in combination with at least any of a yellow toner and a cyan toner, and the particle diameter (primary average particle diameter (nm)) of a pigment contained in the magenta toner is 1.5 times or more the particle diameter (primary average particle diameter (nm)) of a pigment contained in the yellow toner and the cyan toner.

A fourth color toner for electrophotography of the present invention contains: a binder resin; and C.I. pigment Violet 19, wherein the color toner is a magenta toner, and used in combination with at least any of a yellow toner and a cyan toner, and the volume average particle diameter ($D_{50}$) of the magenta toner is smaller than the volume average particle diameter ($D_{50}$) of the yellow toner and the cyan toner by 0.5 μm or more.

A fifth color toner for electrophotography of the present invention contains: a binder resin; C.I. pigment Violet 19; and an infrared absorbent, wherein the color toner is a magenta toner, and used in combination with at least any of a yellow toner and a cyan toner, and the content of the infrared absorbent in the magenta toner is higher than the content of an infrared absorbent in the yellow toner and the cyan toner.

A sixth color toner for electrophotography of the present invention contains: a binder resin; C.I. pigment Violet 19; and waxes, wherein the color toner is a magenta toner, and used in combination with at least any of a yellow toner and a cyan toner, and the content of the waxes in the magenta toner is higher than the content of waxes in the yellow toner and the cyan toner.

The color toner for electrophotography has almost the same fixability as the fixability of the yellow toner or the cyan toner to be used in combination. Therefore, there is hardly any variations in fixability seen when used with the toners of other colors in combination. For this reason, if the color toner for electrophotography is used, it is possible to set the fixing conditions (fixing temperature, and the like) equally among the toners of respective colors. In addition, the toners of respective colors are excellent in fixability and void resistance, so that a high-quality image can be formed.

A developer for electrophotography of the present invention is characterized by containing the color toner for electrophotography of the present invention.

A first color toner set for electrophotography of the present invention comprises: a magenta toner which comprises a binder resin; and at least any of a yellow toner and a cyan toner, wherein the color toner set is used for forming a multicolor image, and the storage modulus ($G'_{100}$) (100° C.) of the binder resin in the magenta toner is (1/1.1) to (1/10) times the storage modulus ($G'_{100}$) (100° C.) of a binder resin contained in the yellow toner and the cyan toner.

A second color toner set for electrophotography of the present invention comprises: a magenta toner which comprises a binder resin having a storage modulus ($G'_{100}$) (100° C.) of $9.0\times10^3$ to $4.0\times10^4$ dyn/cm$^2$ and C.I. pigment Violet 19; and at least any of a yellow toner and a cyan toner each containing a binder resin with a storage modulus ($G'_{100}$) (100° C.) of $4.4\times10^4$ to $8.0\times10^5$ dyn/cm$^2$, wherein the color toner set is used for forming a multicolor image.

A third color toner set for electrophotography of the present invention comprises: a magenta toner which comprises a binder resin, and C.I. pigment Violet 19; and at least any of a yellow toner and a cyan toner, wherein the color toner set is used for forming a multicolor image, and the particle diameter (primary average particle diameter (nm)) of a pigment contained in the magenta toner is 1.5 times or more the particle diameter (primary average particle diameter (nm)) of a pigment contained in the yellow toner and the cyan toner.

A fourth color toner set for electrophotography of the present invention comprises: a magenta toner which comprises a binder resin, and C.I. pigment Violet 19; and at least any of a yellow toner and a cyan toner, wherein the color toner set is used for forming a multicolor image, and the volume average particle diameter ($D_{50}$) of the magenta toner is smaller than the volume average particle diameter ($D_{50}$) of the yellow toner and the cyan toner by 0.5 μm or more.

A fifth color toner set for electrophotography of the present invention comprises: a magenta toner which comprises a binder resin, C.I. pigment Violet 19, and an infrared absorbent; and at least any of a yellow toner and a cyan toner, wherein the color toner set is used for forming a multicolor image, and the content of the infrared absorbent in the magenta toner is higher than the content of an infrared absorbent in the yellow toner and the cyan toner.

A sixth color toner set for electrophotography of the present invention comprises: a magenta toner which comprises a binder resin, C.I. pigment Violet 19, and waxes; and at least any of a yellow toner and a cyan toner, wherein the color toner set is used for forming a multicolor image, and the content of the waxes in the magenta toner is higher than the content of waxes in the yellow toner and the cyan toner.

An apparatus for forming a color image of the present invention is characterized by including: an electrostatic latent image carrier; means for forming an electrostatic latent image on the electrostatic latent image carrier; means for developing the electrostatic latent image using any of the color toner sets for electrophotography of the present invention, and forming a visible image; means for transferring the visible image onto a recording medium; and means for flash fixing a transfer image transferred onto the recording medium.

A method for forming a color image of the present invention is characterized by including: a step for forming an electrostatic latent image on an electrostatic latent image carrier; a step for developing the electrostatic latent image using any of the color toner sets for electrophotography of the present invention, and forming a visible image; a step for transferring the visible image onto a transfer material; and a step for flash fixing a transfer image formed by the visible image being transferred onto the transfer material.

Figure 1:
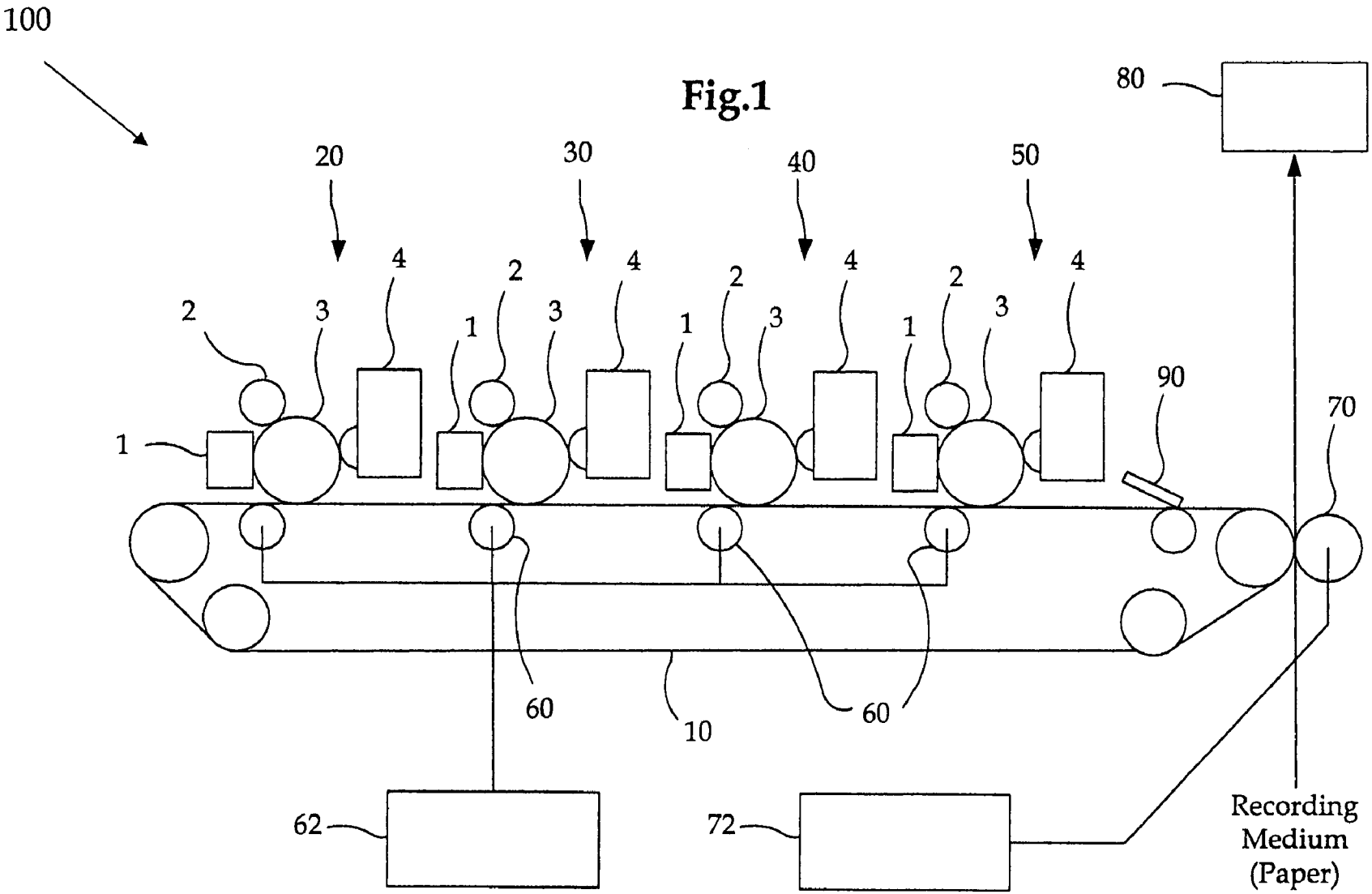
FIG. 1 is a schematic illustrative diagram for illustrating one example of a method for forming a color image of the present invention carried out by the use of an apparatus for forming a color image of the present invention.

DESCRIPTION OF THE PREFERRED EMBODIMENTS (Color Toner for Electrophotography)

The color toner for electrophotography is a magenta toner, and can be preferably used in combination with a yellow toner, a cyan toner, or the like.

The color toner for electrophotography contains a binder resin and a colorant, and if required, contains an infrared absorbent, a charge control agent, and the like. Further, if required, it contains other components.

Preferred examples of the color toner for electrophotography may include the following first to sixth toners.

The first toner contains a binder resin, and is a magenta toner. It is used in combination with at least any of a yellow toner and a cyan toner, and the storage modulus ($G'_{100}$) (100° C.) of the binder resin is (1/1.1) to (1/10) times the storage modulus ($G'_{100}$) (100° C.) of a binder resin contained in the yellow toner and the cyan toner.

The second toner contains: a binder resin having a storage modulus ($G'_{100}$) (100° C.) of $9.0\times10^3$ to $4.0\times10^4$ dyn/cm$^2$; and C.I. pigment Violet 19, and is a magenta toner. It is used in combination with at least any of a yellow toner and a cyan toner each containing a binder resin with a storage modulus ($G'_{100}$) (100° C.) of $4.4\times10^4$ to $8.0\times10^5$ dyn/cm$^2$.

The third toner contains: a binder resin; and C.I. pigment Violet 19, and is a magenta toner. It is used in combination with at least any of a yellow toner and a cyan toner, and the particle diameter (primary average particle diameter (nm)) of a pigment contained in the magenta toner is 1.5 times or more the particle diameter (primary average particle diameter (nm)) of a pigment contained in the yellow toner and the cyan toner.

The fourth toner contains: a binder resin; and C.I. pigment Violet 19, and is a magenta toner. It is used in combination with at least any of a yellow toner and a cyan toner, and the volume average particle diameter ($D_{50}$) of the magenta toner is smaller than the volume average particle diameter ($D_{50}$) of the yellow toner and the cyan toner by 0.5 μm or more.

The fifth toner contains: a binder resin; C.I. pigment Violet 19; and an infrared absorbent, and is a magenta toner. It is used in combination with at least any of a yellow toner and a cyan toner, and the content of the infrared absorbent in the magenta toner is higher than the content of an infrared absorbent in the yellow toner and the cyan toner.

The sixth toner contains: a binder resin; C.I. pigment Violet 19; and waxes, and is a magenta toner. It is used in combination with at least any of a yellow toner and a cyan toner, and the content of the waxes in the magenta toner is higher than the content of waxes in the yellow toner and the cyan toner.

Binder Resin

The binder resin has no particular restriction, and can be appropriately selected according to the intended purpose. Examples thereof may include: natural polymers and thermoplastic resins such as synthetic polymers. Specifically, mention may be preferably made of polyester, styrene-acrylic, styrene-methacrylic, polyvinyl chloride, polyether polyol, and polyester resins, cycloolefin resins such as polyethylene and polypropylene, polyacrylic, polyamide, polyvinyl, phenol, acrylic, and methacrylic resins, polyvinyl acetate, silicone, polyurethane, polyamide, furan, epoxy, xylene, polyvinyl butyral, terpene, coumarone-indene, petroleum, polyether polyol, and polybutadiene resins. Further, mention may also be made of waxes such as ester wax, carnauba wax, Fisher-Tropsch wax, paraffin wax, and rice wax.

These may be used alone, or may also be used in combination of two or more thereof. Out of these, the polyester resin is preferably used alone, or in combination with other binder resins in terms of odor upon flash fixing.

The binder resin has no particular restriction, and can be appropriately selected according to the intended purpose. For example, the weight-average molecular weight is preferably from about 4000 to 100,000, and the melting point is preferably from about 90 to 150° C.

The content of the binder resin in the color toner for electrophotography has no particular restriction. It is preferably 50% by mass or more, and more preferably 70 to 95% by mass in terms of fixability.

Although the glass transition point (Tg) of the binder resin has no particular restriction, it is preferably from about 50 to 70° C.

Colorant Such as Pigment

The colorant is a magenta colorant. The magenta colorant has no particular restriction, and examples thereof may include all of various known pigments and dyes. For example, mention may be made of condensed azo compounds, diketo-pyrrolo-pyrrole compounds, anthraquinone compounds, quinacridone compounds, basic dye lake compounds, naphthol compounds, benzimidazole compounds, thioindigo compounds, and perylene compounds. Specific preferred examples thereof may include: C.I. pigment Violet 19, C.I. pigment Red 2, 3, 5, 6, 7, 23, 48:2, 48:3, 48:4, 57:1, 81:1, 122, 144, 146, 166, 169, 177, 184, 185, 202, 206, 220,221, and 254. These may be used alone, or may also be used in combination of two or more thereof. Out of these, C.I. pigment Violet 19 (quinacridone compound) expressed by the following structural formula is particularly preferred particularly in that an image with a good color tone and a high chroma is formed therefrom. However, for the C.I. pigment Violet 19, the composition tends to increase in viscosity during formation into a toner.

[Chemical Formula 1]

Structural formula (1)

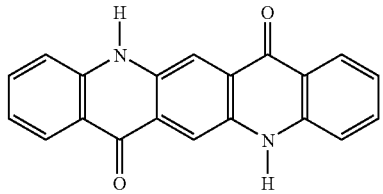

The content of the colorant in the color toner for electrophotography is preferably from 0.1 to 20% by mass, and more preferably from 0.5 to 10% by mass.

Infrared Absorbent

The infrared absorbent is preferably a material having at least one or more intense light absorption peaks in the near-infrared region at 750 to 1200 nm. It may be any of an inorganic infrared absorbent and organic infrared absorbent.

Examples of the inorganic infrared absorbent may include lanthanoid compounds such as ytterbium oxide and ytterbium phosphate, indium tin oxide, and tin oxide.

Examples of the organic infrared absorbent may include aminium compounds, diimonium compounds, naphthalocyanine compounds, cyanine compounds, and polymethine compounds.

These may be used alone, or may also be used in combination of two or more thereof.

The content of the infrared absorbent in the color toner for electrophotography is preferably from 0.1 to 5% by mass, and more preferably from 0.3 to 1% by mass.

If the content is less than 0.1% by mass, the resulting color toner for electrophotography may not be fixed. Whereas, if it exceeds 5% by mass, the color of the image to be formed may become dull.

Charge Control Agent

The charge control agent has no particular restriction, and can be appropriately selected from known ones according to the intended purpose. Examples thereof may include: calixarenes, nigrosine dyes, quaternary ammonium salts, amino group-containing polymers, metal-containing azo dyes, salicylic acid complex compounds, phenol compounds, azo chromium compounds, azo zinc compounds, triphenylmethane derivatives, and zinc naphthoate complex.

These may be used alone, or may also be used in combination of two or more thereof.

Other Components

The other components have no particular restriction, and can be appropriately selected from known ones according to the intended purpose. Examples thereof may include: flow improvers, cleaning activators, magnetic materials, fixing aids, waxes, metallic soaps, and surfactants.

The flow improvers have no particular restriction, and can be appropriately selected from known ones according to the intended purpose. Examples thereof may include inorganic fine particles such as white particles.

Examples of the inorganic fine particles may include: silica fine particles, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

These may be used alone, or may also be used in combination of two or more thereof. Out of these, silica fine particles are preferred. Silica fine particles, the titanium compound, resin fine particles, alumina, and the like are also preferably used in combination.

The content of the flow improver in the color toner for electrophotography is preferably from 0.01 to 5% by mass, and more preferably from 0.01 to 2.0% by mass.

The cleaning activator has no particular restriction, and can be appropriately selected from known ones according to the intended purpose. Examples thereof may include metallic salts of higher fatty acids typified by zinc stearate, or the like, fine-particle powders of fluorinated high molecular polymer.

The magnetic materials have no particular restriction, and can be appropriately selected from known ones according to the intended purpose. Examples thereof may include: iron powder, magnetite, and ferrite. Particularly, white magnetic powder is preferably used in terms of color tone.

Examples of the fixing aids may include waxes and surfactants.

Examples of the waxes may include: ester wax, polyethylene wax, polypropylene wax, ester wax, polypropylene, a copolymeric product of polyethylene and polypropylene, microcrystalline wax, paraffin wax, carnauba wax, SASOL WAX, montanic acid ester wax, deoxidized carnauba wax, palmitic acid, stearic acid, montanic acid, brassidic acid, eleostearic acid, unsaturated fatty acids, saturated alcohols, polyhydric alcohols, fatty acid amides, saturated fatty acid bis amides, unsaturated fatty acid amids, aromatic bisamides, fatty acid metal salts (generally referred to as "metallic soaps"), waxes obtained by grafting vinyl monomers such as styrene or acrylic acid to aliphatic hydrocarbon waxes, partially esterified products of fatty acids such as monoglyceride behenate and polyhydric alcohols, and methyl ester compounds having hydroxyl groups obtained by hydrogenating vegetable fats and oils.

Examples of the unsaturated fatty acids may include: palmitic acid, stearic acid, montanic acid, brassidic acid, eleostearic acid, and parinaric acid.

Examples of the saturated alcohols may include: stearyl alcohol, aralkyl alcohol, behenyl alcohol, carnaubyl alcohol, ceryl alcohol, melissyl alcohol, and long-chain alkyl alcohols having longer-chain alkyl groups.

Examples of the polyhydric alcohols may include sorbitol.

Examples of the fatty acid amides may include: linoleic acid amide, oleic acid amide, and lauric acid amide.

Examples of the saturated fatty acid bisamides may include: methylenebis stearic acid amide, ehylenebis caprylic acid amide, ethylenebis lauric acid amide, and hexamethylenebis stearic acid amide.

Examples of the unsaturated fatty acid amides may include: ethylenebis oleic acid amide, hexamethylenebis oleic acid amide, N,N'-dioleyladipic acid amide and N,N'-dioleyl sebacic acid amide.

Examples of the aromatic bisamides may include m-xylenebis stearic acid amide and N,N'-distearyl isophthalic acid amide.

Examples of the fatty acid metal salts may include calcium stearate, calcium laurate, zinc stearate, and magnesium stearate.

These waxes may be used alone, or may also be used in combination of two or more thereof.

Out of these waxes, the ones each showing an endothermic peak at 50 to 90° C. during the DSC measurement are preferred as the waxes.

If the temperature of the endothermic peak is less than 50° C., blocking may occur. Whereas, if the temperature exceeds 90° C., the wax may be incapable of contributing to the fixability.

Incidentally, in the DSC measurement, measurement is preferably carried out by the use of a high-precision inner heat type input compensation model differential scanning calorimeter with a differential thermal analysis method in the following manner. Namely, the temperature at which the endothermic peak is observed is determined by means of a differential thermal analysis measuring apparatus (DSC measuring apparatus; DSC7 (manufactured by Perkin-Elmer Co., Ltd). 5 to 20 mg (preferably 10 mg) of test samples are weighed with precision. Each sample is placed in an aluminium pan, while an empty aluminium pan is used as a reference. The measurements are carried out at a measuring temperature in the range of 30 to 200° C. at a heating rate of 10° C./min under the conditions of normal temperature and normal humidity. The measurements are carried out at a temperature in the range of 40 to 200° C. during the temperature-rising process.

Examples of the surfactants may include non-ionic surfactants.

In the first toner, the storage modulus ($G'_{100}$) (100° C.) of the binder resin contained therein is required to be (1/1.1 to 1/10) times, and is preferably (1/1.2 to 1/9) times, and more preferably (1/1.3 to 1/8) times higher than the storage modulus the ($G'_{100}$) (100° C.) of the binder resin contained in the yellow toner and the cyan toner.

If the ratio of the storage modulus ($G'_{100}$) (100° C.) of the binder resin contained in the magenta toner to the storage modulus the ($G'_{100}$) (100° C.) of the binder resin contained in the yellow toner and the cyan toner to be used in combination falls within the range of the foregoing ratios, it is possible to make the fixability of the magenta toner generally equal to the fixability of the yellow toner and the cyan toner to be used in combination. Therefore, the first toner is advantageous in that it is capable of forming a high-quality image excellent in fixability and void resistance under the fixing conditions (such as the fixing temperature) common to toners of respective colors.

Incidentally, the void is an image defect uniquely occurring upon performing flash fixing, and a phenomenon that a printed part is left out to be in white. The void is caused due to the following reasons. For example, the outermost surface temperature of the toner is increased up to about 500° C. during flash fixing. Accordingly, the toner is fused, so that the air mixed in the toner expands all at once. As a result, the toner is blown off. Toner particles flocculate upon fusing due to the surface tension of the toner particles.

In the second toner, the storage modulus ($G'_{100}$) (100° C.) of the binder resin contained therein is required to be $9.0\times10^3$ to $4.0\times10^4$ dyn/cm$^2$, and is preferably $9.5\times10^3$ to $3.5\times10^4$ dyn/cm$^2$, and more preferably $1.0\times10^4$ to $3.0\times10^4$ dyn/cm$^2$.

Incidentally, in this case, the storage modulus ($G'_{100}$) (100° C.) of the binder resin contained in at least any of the yellow toner and the cyan toner to be used in combination with the second toner is required to be $4.4\times10^4$ to $8.0\times10^5$ dyn/cm$^2$, and is preferably $5.0\times10^4$ to $6.5\times10^5$ dyn/cm$^2$, and more preferably $5.5\times10^4$ to $8.0\times10^5$ dyn/cm$^2$.

In the first and second toners, why the temperature condition for measuring the storage modulus ($G'_{100}$) is set to be 100° C. is for the following reason. 100° C. is close to the average toner temperature upon flash fixing (however, the instantaneous temperature of the toner outermost surface layer upon flash fixing is about 500° C.). Thus, by performing the evaluation using the storage modulus at 100° C. as a reference, conveniently, it becomes easy to judge whether the color toner for electrophotography is preferably suitable or not for the image forming process in which flash fixing is performed.

In the third toner, the ratio of the particle diameter (primary average particle diameter (nm)) of the pigment contained therein to the particle diameter (primary average particle diameter (nm)) of a pigment contained in the yellow toner and the cyan toner to be used in combination is required to be 1.5 or more, and preferably 1.8 or more, and more preferably 2.0 or more.

If the ratio (the particle diameter (primary average particle diameter (nm)) of the pigment contained in the magenta toner/the particle diameter (primary average particle diameter (nm)) of the pigment contained in the yellow toner and the cyan toner) falls within the foregoing numerical value range, it is possible to make the fixability of the magenta toner generally equal to the fixability of the yellow toner and the cyan toner to be used in combination. Therefore, the third toner is advantageous in that it is capable of forming a high-quality image excellent in fixability and void resistance under the fixing conditions (such as the fixing temperature) common to toners of respective colors.

In the fourth toner, the volume average particle diameter ($D_{50}$) thereof is required to be smaller by 0.5 μm or more, and is preferably smaller by 0.7 μm or more, and more preferably smaller by 0.9 μm or more than the volume average particle diameter ($D_{50}$) of the yellow toner and the cyan toner.

If the volume average particle diameter ($D_{50}$) satisfies the foregoing relationship, it is possible to make the fixability of the magenta toner generally equal to the fixability of the yellow toner and the cyan toner to be used in combination. Therefore, the fourth toner is advantageous in that it is capable of forming a high-quality image excellent in fixability and void resistance under the fixing conditions (such as the fixing temperature) common to toners of respective colors.

In the fifth toner, the content of the infrared absorbent is required to be higher than the content of the infrared absorbent in the yellow toner and the cyan toner to be used in combination. It is preferably 0.1% by mass or more, and more preferably 0.2% by mass.

If the content of the infrared absorbent is higher than the content of the infrared absorbent in the yellow toner and the cyan toner to be used in combination, it is possible to make the fixability of the magenta toner generally equal to the fixability of the yellow toner and the cyan toner to be used in combination. Therefore, the fifth toner is advantageous in that it is capable of forming a high-quality image excellent in fixability and void resistance under the fixing conditions (such as the fixing temperature) common to toners of respective colors.

In the sixth toner, the content of the waxes is required to be higher than the content of the waxes in the yellow toner and the cyan toner to be used in combination. It is preferably 0.5% by mass or more, and more preferably 1.0% by mass or more.

If the relationship between the content of the waxes and the content of the waxes in the yellow toner and the cyan toner to be used in combination satisfies the foregoing relationship, it is possible to make the fixability of the magenta toner generally equal to the fixability of the yellow toner and the cyan toner to be used in combination. Therefore, the sixth toner is advantageous in that it is capable of forming a high-quality image excellent in fixability and void resistance under the fixing conditions (such as the fixing temperature) common to toners of respective colors.

A method for manufacturing the color toner for electrophotography has no particular restriction, and can be appropriately selected from known methods according to the intended purpose. For example, mention may be made of the following mechanical grinding method, and the like. Namely, the colorant, the infrared absorbent, the binder resin, the charge control agent, other components, and the like are mixed by means of a mixing device such as a HENSCHEL MIXER The resulting mixture is melt-kneaded by means of a heat kneading machine such as a heating roll, a kneader, or an extruder to make the components compatible with each other. Then, the metal compound, pigment, dye, magnetic material, and the like are dispersed or dissolved, followed by cooling for solidification. Thereafter, the solidified mixture is ground by means of a grinding machine such as a jet mill, and the resulting particles are classified into a desired particle diameter to manufacture toner particles. With this method, further if required, a desired additive may also be sufficiently mixed by means of a mixing machine such as a HENSCHEL MIXER.

The color toner for electrophotography of the present invention can be preferably used for a color developer for electrophotography, and a method for forming an image and an image forming apparatus by an electrophotographic system. In particular, it can be preferably used for a color toner set for electrophotography, a color developer for electrophotography, an apparatus for forming a color image, and a method for forming a color image, of the present invention described below.

(Color Toner Set for Electrophotography)

The color toner set for electrophotography may be a set of two to three colors of the aforesaid toner for electrophotography as the magenta toner, and at least any of a yellow toner and a cyan toner. Further, it may also be a full-color set of four colors of toners including a black toner.

In the color toner set for electrophotography, toners of respective colors are preferably held in their respective corresponding toner bottles.

Preferred examples of the color toner set for electrophotography may include the following first to sixth sets.

The first set contains the first toner and at least any of a yellow toner and a cyan toner. More specifically, it is the color toner set for electrophotography which contains a magenta toner which comprises a binder resin; and at least any of a yellow toner and a cyan toner, and is used for forming a multicolor image, wherein the storage modulus ($G'_{100}$) (100° C.) of the binder resin in the magenta toner is (1/1.1) to (1/10) times the storage modulus ($G'_{100}$) (100° C.) of a binder resin contained in the yellow toner and the cyan toner.

The second set contains the second toner, and at least any of a yellow toner and a cyan toner. More specifically, it is the color toner set for electrophotography which contains: a magenta toner containing a binder resin having a storage modulus ($G'_{100}$) (100° C.) of $9.0\times10^3$ to $4.0\times10^4$ dyn/cm$^2$ and C.I. pigment Violet 19; and at least any of a yellow toner and a cyan toner each containing a binder resin with a storage modulus ($G'_{100}$) (100° C.) of $4.4\times10^4$ to $8.0\times10^5$ dyn/cm$^2$, and is used for forming a multicolor image.

The third set contains the third toner, and at least any of a yellow toner and a cyan toner. More specifically, it is the color toner set for electrophotography which contains: a magenta toner containing a binder resin, and C.I. pigment Violet 19; and at least any of a yellow toner and a cyan toner, and is used for forming a multicolor image, wherein the particle diameter (primary average particle diameter (nm)) of a pigment contained in the magenta toner is 1.5 times or more the particle diameter (primary average particle diameter (nm)) of a pigment contained in the yellow toner and the cyan toner.

The fourth set contains the fourth toner, and at least any of a yellow toner and a cyan toner. More specifically, it is the color toner set for electrophotography which contains: a magenta toner containing a binder resin, and C.I. pigment Violet 19; and at least any of a yellow toner and a cyan toner, and is used for forming a multicolor image, wherein the volume average particle diameter ($D_{50}$) of the magenta toner is smaller than the volume average particle diameter ($D_{50}$) of the yellow toner and the cyan toner by 0.5 μm or more.

The fifth set contains the fifth toner, and at least any of a yellow toner and a cyan toner. More specifically, it is the color toner set for electrophotography which contains: a magenta toner containing a binder resin, C.I. pigment Violet 19, and an infrared absorbent; and at least any of a yellow toner and a cyan toner, and is used for forming a multicolor image, wherein the content of the infrared absorbent in the magenta toner is higher than the content of an infrared absorbent in the yellow toner and the cyan toner.

The sixth set contains the sixth toner, and at least any of a yellow toner and a cyan toner. More specifically, it is the color toner set for electrophotography which contains: a magenta toner containing a binder resin, C.I. pigment Violet 19, and waxes; and at least any of a yellow toner and a cyan toner, and is used for forming a multicolor image, wherein the content of the waxes in the magenta toner is higher than the content of waxes in the yellow toner and the cyan toner.

Each toner composition in the yellow toner and the cyan toner to be used in combination with the color toner for electrophotography is all the same as that of the toner for electrophotography except for the following colorants.

Examples of the colorant to be used for the yellow toner may include: condensed azo compounds, isoindolinone compounds, anthraquinone compounds, azo metal complexes, methine compounds, and allyl amide compounds. Specific preferred examples thereof may include C.I. pigment Yellow 12, 13, 14, 15, 17, 62, 74, 83, 93, 94, 95, 109, 110, 111, 128, 129, 147, 168, 180, and 185. Out of these, C.I. pigment Yellow 180, 185, and the like are preferred particularly in terms of color tone.

Examples of the colorant to be used for the cyan toner may include: copper phthalocyanine compounds and derivatives thereof, anthraquinone compounds, and basic dye lake compounds. Specifically, C.I. pigment Blue 1, 7, 15, 15:1, 15:2, 15:3, 15:4, 60, 62, 66, and the like may be preferably used. Out of these, C.I. pigment Blue 15:1, 15:3, and the like are preferred particularly in terms of color tone.

Further, examples of the colorant in the black toner may include: Carbon Black, Lamp Black, iron black, ultramarine blue, nigrosine dye, and Aniline Blue.

Out of these, preferably, the magenta toner contains the C.I. pigment Violet 19, the yellow toner contains C.I. pigment Yellow 180 and 185, and further, the cyan toner contains C.I. pigment Blue 15:1 and 15:3, because the resulting image is very good in fixability and void resistance.

(Color Developer for Electrophotography)

The color developer for electrophotography contains at least the color toner for electrophotography, and further, if required, it contains a carrier and other components.

The color developer for electrophotography may be implemented in accordance with any of an aspect in which the developer contains the color toner for electrophotography of the present invention, so that it is monochromatic; another aspect in which the developer contains the color toner for electrophotography of the present invention, and at least any of a yellow toner and a cyan toner, so that it is of two to three colors; and a still other aspect in which the developer contains the color toner for electrophotography of the present invention, a yellow toner and a cyan toner, and further a black toner, so that it is of four full color.

The color developer for electrophotography may be a one-component developer made of the color toner for electrophotography, or may also be a two-component developer containing the color toner for electrophotography and a carrier. However, when it is used for a high-speed printer adaptable to a recent improvement in information processing speed, or the like, the two-component developer is preferred in terms of improvement in life, and the like.

Carrier

The carrier has no particular restriction, and can be appropriately selected according to the intended purpose. The ones each having a core material and a resin layer covering the core material are preferred.

Preferred examples of the material for the core material may include 50 to 90-emu/g manganese-strontium (Mn—Sr) system materials and manganese-magnesium (Mn—Mg) system materials. High magnetization materials such as iron powder (100 emu/g or more), magnetite (75 to 120 emu/g), and ferrite are preferred from the viewpoint of ensuring the image concentration. Low magnetization materials such as copper-zinc (Cu—Zn) system (30 to 80 emu/g) are preferred in that the resulting carrier can more softly touch the photoconductor on which the toner particles are disposed in a state of standing upwards, which is advantageous for enhancing the quality of the image. These may be used alone, or may also be used in combination with two or more thereof.

The particle diameter of the core material is preferably from 10 to 50 μm, and more preferably 40 to 100 μm in average particle diameter (volume average particle diameter ($D_{50}$)).

If the average particle diameter (volume average particle diameter ($D_{50}$)) is less than 10 μm, particles of a fine-powder type are increased in amount in the distribution of carrier particles. As a result, the magnetization per particle lowers, which may cause scattering of carrier particles. If it exceeds 150 μm, the specific surface area decreases, which may cause scattering of toner particles. Thus, for a full-color image rich in filled-in portions, particularly, the filled-in portions may be reproduced poorly.

The materials for the resin layer has no particular restriction, and can be appropriately selected from known materials according to the intended purpose. Preferred examples thereof from the viewpoints of the durability and the long-life property may include: silicone resins such as silicone resin, acrylic-modified silicone resins, and fluorine-modified silicone resins. These may be used alone, or may also be used in combination with two or more thereof.

The resin layer can be formed in the following manner. For example, the silicone resin, or the like is dissolved in a solvent to prepare a coating solution. Then, the coating solution is uniformly coated on the surface of the core material by a known coating method such as a dipping method, a spray method, or a brushing method. The applied coating solution is dried, followed by burning, or the like.

The solvent has no particular restriction, and can be appropriately selected according to the intended purpose. Examples thereof may include: toluene, xylene, methyl ethyl ketone, methyl isobutyl ketone, and butyl cellosolve acetate.

The burning may be accomplished by an externally heating method, or an internally heating method, examples of which may include: a method using a fixed-type electric furnace, a fluid-type electric furnace, a rotary-type electric furnace, a burner furnace, or the like and a method using a microwave.

The proportion of the resin layer in the carrier (resin coating amount) is preferably from 0.01 to 5.0% by mass based on the total amount of the carrier.

If the proportion (resin coating amount) is less than 0.01% by mass, it may be impossible to form the resin layer uniformly on the surface of the core material. If it exceeds 5.0% by mass, the resulting resin layer may be too thick, so that granulation occurs among carrier particles. As a result, it may be impossible to obtain uniform carrier particles.

When the color developer for electrophotography is the two-component developer, the content of the carrier in the two-component developer has no particular restriction, and can be appropriately selected according to the intended purpose. For example, it is preferably more than 50% by mass and less than 99% by mass, and more preferably more than 90% by mass and less than 97% by mass (i.e., the content of the color toner for electrophotography in the two-component developer is preferably from 1 to 50% by mass, and more preferably 3 to 10% by mass).

The color developer for electrophotography of the present invention can be preferably used for image forming by various known electrophotographic methods such as a magnetic one-component developing method, a non-magnetic one-component developing method, and a two-component developing method. In particular, it can be preferably used for the following apparatus for forming a color image and method for forming a color image of the present invention.

(Method for Forming a Color Image and Apparatus for Forming a Color Image)

A method for forming a color image of the present invention includes at least, a step for forming an electrostatic latent image on an electrostatic latent image carrier; a step for developing the electrostatic latent image using the color toner for electrophotography of the present invention, and forming a visible image; a step for transferring the visible image onto a recording medium; and a step for flash fixing the transfer image transferred onto the recording medium.

An apparatus for forming a color image of the present invention includes at least, an electrostatic latent image carrier; means for forming an electrostatic latent image on the electrostatic latent image carrier; means for developing the electrostatic latent image using the color toner for electrophotography of the present invention, and forming a visible image; means for transferring the visible image onto a recording medium; and means for flash fixing the transfer image transferred onto the recording medium.

The method for forming a color image of the present invention includes, as described above, a step for forming an electrostatic latent image, a step for developing, a step for transferring, and a step for flash fixing. If required, it may also include appropriately selected other steps such as a step for charge eliminating, a step for cleaning, a step for recycling, and a step for controlling.

The apparatus for forming a color image s of the present invention includes, as described above, an electrostatic latent image carrier, means for forming an electrostatic latent image, means for developing, means for transferring, and means for flash fixing. If required, it may also include appropriately selected other means such as means for charge eliminating, means for cleaning, means for recycling, and means for transferring.

The method for forming a color image of the present invention can be preferably carried out by the apparatus for forming a color image of the present invention. The step for forming an electrostatic latent image can be carried out by the means for forming an electrostatic latent image. The step for developing can be carried out by the means for developing. The step for transferring can be carried out by the means for transferring. The step for flash fixing can be carried out by the means for flash fixing. The other steps can be carried out by the other means.

Step for Forming an Electrostatic Latent Image and Means for Forming an Electrostatic Latent Image The step for forming the electrostatic latent image is a step for forming an electrostatic latent image on an electrostatic latent image carrier.

The electrostatic latent image carrier (may be referred to as a "photoconductive insulator", or a "photoconductor") has no particular restriction as to the material, shape, structure, size, quality of material, and the like, and can be appropriately selected from known ones. As the shape, mention may be preferably made of a drum-like shape. Examples of the material may include: inorganic photoconductors such as amorphous silicon and selenium, and organic photoconductors such as polysilane and phthalopolymethine. Out of these, amorphous silicon, and the like are preferred in terms of long-life property.

The electrostatic latent image can be formed in the following manner. For example, the surface of the electrostatic latent image carrier is uniformly charged, followed by imagewise exposure. This can be carried out by the means for forming the electrostatic latent image.

The means for forming an electrostatic latent image includes at least a charger for uniformly charging the surface of the electrostatic latent image carrier, and an exposing unit for imagewise exposing the surface of the electrostatic latent image carrier.

The charging can be accomplished by, for example, applying the surface of the electrostatic latent image carrier with a voltage by the use of the charger.

The charger has no particular restriction, and can be appropriately selected according to the intended purpose. Examples thereof may include: contact chargers known themselves including conductive or semiconductive roll, brush, film, rubber blade, and the like, and non-contact chargers utilizing corona discharge, such as a corotron and a scorotron.

The exposure can be accomplished by, for example, imagewise exposing the surface of the electrostatic latent image carrier by the use of the exposing unit.

The exposing unit has no particular restriction so long as it is capable of exposing the surface of the electrostatic latent image carrier charged by the charger to light in the pattern corresponding to the image to be formed. It can be appropriately selected according to the intended purpose. Examples thereof may include various exposing units such as a copying optical system, a rod lens array system, a laser optical system, and a liquid crystal shutter optical system.

Incidentally, in the present invention, an optical back process may also be adopted in which the electrostatic latent image carrier is imagewise exposed from its back side.

Step for Developing and Means for Developing

The step for developing is a step for developing the electrostatic latent image using the color developer for electrophotography containing the color toner set for electrophotography of the present invention, and forming a visible image.

The visible image can be formed by, for example, developing the electrostatic latent image using the color toner for electrophotography of the present invention, and the formation can be accomplished by the means for developing.

The means for developing has at least a developing unit for holding the color toner for electrophotography, and supplying the color toner for electrophotography to the electrostatic latent image in a contact or non-contact manner.

The developing unit may be of a dry development system, or it may also be of a wet development system. Alternatively, it may be a developing unit for monochrome, or it may also be a developing unit for multicolor. Preferred examples thereof may include the one having a stirrer for friction-stirring and charging the color toner for electrophotography, and a rotatable magnet roller.

In the developing unit, for example, the color toner for electrophotography and the carrier are mixed with stirring. The color toner for electrophotography is charged due to the friction at this step, and stood upwards on the surface of the rotating magnet roller to form a magnetic brush. The magnet roller is placed in the vicinity of the electrostatic latent image carrier (photoconductor). Therefore, a part of the color toner for electrophotography constituting the magnetic brush formed on the surface of the magnet roller moves onto the surface of the electrostatic latent image carrier (photoconductor) by the electric attraction force. As a result, the electrostatic latent image is developed by the color toner for electrophotography, so that a visible image by the color toner for electrophotography is formed on the surface of the electrostatic latent image carrier (photoconductor).

The developer to be held in the developing unit is the color developer for electrophotography of the present invention containing the color toner for electrophotography of the present invention. The color developer for electrophotography may be a one-component developer or may also be a two-component developer. The toner to be contained in the color developer for electrophotography is the color toner for electrophotography or the color toner set for electrophotography of the present invention.

Step for Transferring and Means for Transferring

The step for transferring is a step for transferring the visible image onto a recording medium. In accordance with a preferred aspect thereof, the step includes a first step for transferring a lowermost layer visible image and an upper layer visible image in this order onto an intermediate transfer member, and forming a composite transfer image; and a second step for transferring the composite transfer image on a recording medium so that the lowermost layer visible image in the composite transfer image is situated immediately on the recording medium.

The transfer of the visible image can be carried out by charging the electrostatic latent image carrier (photoconductor) by using a transfer charger, and this process can be accomplished by the means for transferring. In accordance with a preferred aspect thereof, the means for transferring includes a first means for transferring a lowermost layer visible image and an upper layer visible image in this order onto an intermediate transfer member, and forming a composite transfer image; and a second means for transferring the composite transfer image on a recording medium so that the lowermost layer visible image in the composite transfer image is situated immediately on the recording medium.

Incidentally, the intermediate transfer member has no particular restriction, and can be appropriately selected from known transfer members according to the intended purpose.

Incidentally, for the transfer, a black toner image is irrelevant to the color reproducibility in color superimposition, and hence it can be transferred in a given turn. However, it is preferably transferred in the final turn from the viewpoint of black component generation.

The means for transferring (the first means for transferring, the second means for transferring) has at least a transfer unit for charging the visible image formed on the electrostatic latent image carrier (photoconductor), and peeling it, and transferring it onto the recording medium side. The number of the means for transferring may be one, or may also be two or more.

Examples of the transfer unit may include: a corona transfer unit by corona discharge, a transfer belt, a transfer roller, a pressure transfer roller, and an adhesion transfer roller.

Incidentally, the recording medium has no particular restriction, and can be appropriately selected from known recording media (recording paper).

Step for Flash Fixing and Means for Flash Fixing

The step for flash fixing is a step for flash fixing the visible image transferred onto the recording medium by means of a flash light fixing apparatus. The image of each colored toner for electrophotography may be flash fixed every time it is transferred onto the recording medium. Alternatively, the images of respectively colored toners for electrophotography may also be flash fixed simultaneously at a time in a superimposed manner. These procedures can be appropriately selected, but the latter is particularly preferred in terms of efficiency.

The optical energy for the flash fixing (may also be referred to as "flash energy") is preferably about 1 to 3 J/cm$^2$ per color of the color toner. When images of four colors are fixed all together, the optical energy is preferably about 2 to 7 J/cm$^2$, and more preferably about 3 to 5 J/cm$^2$.

If the optical energy falls short of the numeric value range, the fixing may not be carried out favorably. On the other hand, if it exceeds the numeric value range, a toner void, a burn of paper, and the like may occur.

The flash fixing can be accomplished by, for example, irradiating the visible image transferred onto the recording medium with light by means of a flash fixing unit, and can be carried out by the means for flash fixing.

The means for flash fixing has at least a flash fixing unit (flash lamp) for emitting an infrared ray. The number of the means for flash fixing may be one, or may also be two or more.

The flash fixing unit (flash lamp) has no particular restriction, and can be appropriately selected according to the intended purpose. Preferred examples thereof may include an infrared lamp and a xenon lamp.

The light emission wavelength by the means for flash fixing in the flash fixing is preferably close to the absorption wavelength in the infrared absorbent to be used.

The optical energy (J/cm$^2$) per unit area for every flash light denoting the intensity of light emission by the flash fixing unit (flash lamp) can be calculated from the following equation (1):

$$S=((1/2)\times C\times V^2)/(u\times l)/(n\times f), \quad (1)$$

wherein "n" denotes the number of the lamps; "f", the lightening frequency (Hz); "V", the input voltage (V); "C" the capacitor capacity (μF): "u", the process carrying rate (mm/s); "l", the printing width (mm); and "S", the energy density (J/cm$^2$).

Incidentally, in the present invention, for example, a known fixing unit such as a heat roller fixing unit can be used together with, or in place of the step for flash fixing and the means for flash fixing according to the intended purpose.

The step for charge eliminating is a step for applying the electrostatic latent image carrier with a discharge bias, and eliminating charges, and can be preferably carried out by means for charge eliminating.

The means for charge eliminating has no particular restriction so long as it is capable of applying the electrostatic latent image carrier with a discharge bias. It can be appropriately selected from known charge eliminators. Preferable examples thereof may include a discharge lamp.

The step for cleaning is a step for removing the toner for electrophotography remaining on the electrostatic latent image carrier, and can be preferably carried out by means for cleaning.

The cleaning means has no particular restriction so long as it is capable of removing the toner for electrophotography remaining on the electrostatic latent image carrier. It can be appropriately selected from known cleaners. Examples thereof may include: a magnetic brush cleaner, an electrostatic brush cleaner, a magnetic roller cleaner, a blade cleaner, a brush cleaner, and a web cleaner.

The step for recycling is a step for recycling the color toner for electrophotography removed by the cleaning step to the means for developing, and can be preferably carried out by means for recycling.

The means for recycling has no particular restriction. Examples thereof may include known carrying means.

The step for controlling is a step for controlling the respective steps, and can be preferably carried out by a control means.

The control means has no particular restriction so long as it is capable of controlling the motion of each of the means. It can be appropriately selected according to the intended purpose. Examples thereof may include: instruments such as a sequencer and a computer.

A preferred aspect for carrying out the method for forming a color image of the present invention using the apparatus for forming a color image of the present invention will be specifically described by reference to FIG. 1. As shown in FIG. 1, an apparatus for forming a color image 100 includes: an intermediate transfer member 10, a black development unit 20, a cyan development unit 30, a magenta development unit 40, a yellow development unit 50, first means for transferring 60, a second means for transferring 70, means for flash fixing 80, and means for cleaning 90.

The intermediate transfer member 10 is a rotary belt, and rotatably disposed in a stretched manner by four rotary rollers. In the outer periphery thereof, the black development unit 20, the cyan development unit 30, the magenta development unit 40, the yellow development unit 50, and the second means for transferring 70 are placed in this order in opposed relation to the intermediate transfer member 10. The intermediate transfer member 10 rotates from the side of the second means for transferring 70 in the direction toward the black development unit 20. Incidentally, the second means for transferring 70 is a transfer charging unit, and is drivable by a second transfer electric potential supply means 72.

In the inner periphery of the intermediate transfer member 10, the four first means for transferring 60 are disposed in opposed relation to the black development unit 20, the cyan development unit 30, the magenta development unit 40, and the yellow development unit 50. Incidentally, the first means for transferring 60 are transfer chargers, and is drivable by the first transfer electric potential supply means 62.

Each of the black development unit 20, the cyan development unit 30, the magenta development unit 40, and the yellow development unit 50 is a development unit including a charging means 1, an exposure means 2, an electrostatic latent image carrier (photoconductor) 3, and a means for developing 4. Out of these, the electrostatic latent image carrier (photoconductor) 3 is disposed in opposed relation to the outer periphery of the intermediate transfer member 10. Then, around the electrostatic latent image carrier (photoconductor) 3, the charging means 1, the exposure means 2, and the development unit 4 are placed in opposed relation to the electrostatic latent image carrier (photoconductor) 3.

With the apparatus for forming a color image 100, a color image can be formed in the following manner. First, in the black development unit 20, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the black image to be formed. As a result, a black electrostatic latent image is formed on the electrostatic latent image carrier (photoconductor) 3. Then, the means for developing 4 supplies the black toner held therein onto the black electrostatic latent image, and thereby develops it to form a black visible image.

Then, in the cyan development unit 30, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the cyan image to be formed. As a result, a cyan electrostatic latent image is formed on the electrostatic latent image carrier (photoconductor) 3. Then, the means for developing 4 supplies the cyan toner held therein onto the cyan electrostatic latent image, and thereby develops it to form a cyan visible image.

Then, in the magenta development unit 40, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the magenta image to be formed. As a result, a magenta electrostatic latent image is formed on the electrostatic latent image carrier (photoconductor) 3. Then, the means for developing 4 supplies the magenta toner held therein onto the magenta electrostatic latent image, and thereby develops it to form a magenta visible image.

Then, in the yellow development unit 50, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the yellow image to be formed. As a result, a yellow electrostatic latent image is formed on the electrostatic latent image carrier (photoconductor) 3. Then, the means for developing 4 supplies the yellow toner held therein onto the yellow electrostatic latent image, and thereby develops it to form a yellow visible image.

Then, the black visible image, the cyan visible image, the magenta visible image, and the yellow visible image formed on the respective electrostatic latent image carriers (photoconductors) 3 in the black development unit 20, the cyan development unit 30, the magenta development unit 40, and the yellow development unit 50 are sequentially transferred and superimposed one on another onto the intermediate transfer member 10 in this order by the action of the transfer potentials resulting from the respective first means for transferring 60. In consequence, a full-color transfer image by black, cyan, magenta, and yellow is formed.

Then, the transfer images are transferred at a time in this order onto a recording medium by the action of the transfer potential resulting from the second means for transferring 70. In consequence, a full-color transfer image by black, cyan, magenta, and yellow is formed on the recording medium. Incidentally, at this step, the toners are stacked in the order of yellow, magenta, cyan, and black from the recording medium side in the resulting transfer image.

Then, the transfer image formed on the recording medium is carried to the means for flash fixing 80, where it is irradiated with light from the means for flash fixing 80 there to be fused. In consequence, it is fixed on the recording medium. In this manner, the composite transfer image is firmly fixed on the recording medium to form a full-color image by the composite transfer image.

Incidentally, the toner remaining on the intermediate transfer member 10 is removed by a cleaning blade as the cleaning means 90.

In accordance with the method for forming a color image and the apparatus for forming a color image of the present invention, it is possible to efficiently form an image for which sufficient fixability and void resistance are ensured.

Below, the present invention will be described by way of examples and comparative examples, which should not be construed as limiting the scope of the present invention.

Manufacturing of Color Toner for Electrophotography

The color toners for electrophotography, having their respective compositions shown Tables 3 to 7 (magenta toners 1 to 4 and 6 to 15, cyan toners 1 to 4 and 6 to 9, and yellow toners 1 to 4 and 6 to 9) were manufactured in the following manner.

The components of each composition shown in Tables 3 to 7 were put into a HENSCHEL MIXER, and pre-mixed. Then, the resulting mixture was knead by an extruder, and was roughly ground by a hammer mill, followed by fine grinding by a jet mill. The resulting particles were classified by an air classifier to obtain colored fine particles. Subsequently, 0.5 parts by mass of hydrophobic silica fine particles (R974, manufactured by Japan Aerosil Co.,) were subjected to an external addition process by a HENSCHEL MIXER. In consequence, respective color toners for electrophotography (magenta toners 1 to 4 and 6 to 15, cyan toners 1 to 4 and 6 to 9, and yellow toners 1 to 4 and 6 to 9) were manufactured.

Incidentally, in manufacturing of the color toners for electrophotography, the storage modulus ($G_{100}$) at 100° C of each of the binder resins used (binder resins 1-4 and 6 ), the particle diameter (primary average particles diameter (nm)) of each of the pigments (magenta pigments 1 to 5, cyan pigments 1 to 4, and yellow pigments 1 to 4), the volume average particle diameter ($D_{50}$) of each of the resulting color toners (magenta toners 1 to 4 and 6 to 15, cyan toners 1 to 4 and 6 to 9, and yellow toners 1 to 4 and 6 to 9) were determined in the following manner.

Incidentally, the measurement results of each storage modulus ($G'_{100}$) at 100° C. are shown in Table 1; those for the particle diameter (primary average particles diameter (nm)) of each pigment, in Table 2; and for the volume average particle diameter ($D_{50}$) of each color toner, in Tables 3 to 7.

(Measurement of Storage Modulus)

The storage modulus at 100° C of each of the binder resins 1 to 4 and 6 were determined by means of a viscoelasticity measuring device (Rheometer) RDA-II model (manufactured by Rheometrics Corp.) under the following conditions. Namely, as test jigs, a 7.9-mm-dia parallel plate was used when the elastic modulus of a test sample was high, and a 25-mm-dia one was used when the elastic modulus was low. As the test sample, there was used the one obtained by heating and fusing the binder resin, and then forming it into a disk-like sample with a diameter of about 8 mm and a height of 2 to 5 mm, or a disk-like sample with a diameter of about 25 mm and a thickness of 2 to 3 mm. The measuring frequency was set to be 6.28 rad/sec. The measuring strain was set to be 0.1% as the initial value, and the measurement was carried out in the automatic measurement mode. The extension correction of the sample was controlled in the automatic measurement mode. The measuring temperature was increased from 25° C to 150° C at a rate of 1° C/min.

TABLE 1

| | Storage modulus at 100° C. ($dyn/cm^2$) |
|---|---|
| Binder resin 1 | $7.3 \times 10^3$ |
| Binder resin 2 | $9.0 \times 10^3$ |
| Binder resin 3 | $4.0 \times 10^4$ |
| Binder resin 4 | $4.4 \times 10^4$ |
| Binder resin 6 | $7.6 \times 10^5$ |

(Particle Diameter (Primary Average Particle Diameter of Pigment)

The particle diameter (primary average particle diameter) of each of the colorants used (magenta pigments 1 to 5, cyan pigments 1 to 4, and yellow pigments 1 to 4) was calculated in terms of the "Feret diameter" in the following manner.

Namely, color toner particles frozen by a liquid nitrogen were cut by means of a microtome to produce toner microsections. The TEM photograph (magnification of 50,000 times) of the resulting toner microsections was taken. The TEM image thus obtained was read into a Dot Analyzer DA-5000S (manufactured by Oji Scientific Instruments Co., Ltd.). Then, the "Feret diameter" was calculated from the TEM image by means of the same device. This operation was performed for 10 particles of the color toners (a total number of colorant particles: 200), and the average value was defined as the primary average primary diameter. Incidentally, the "Feret diameter" is used for the process of defining the solid particle diameter. It was determined as the average value of the diameters of the projected particles determined at 8 different angles (0, 22.5, 45, 67.5, 90, −22.5, −45, and −67.5 degrees).

TABLE 2

| | C.I. Pigment | Primary average particle diameter (nm) | Product number | Manufacturer |
|---|---|---|---|---|
| Magenta pigment 1 | Violet 19 | 70 | Hostaperm Red E5B02 | Clariant |
| Magenta pigment 2 | Violet 19 | 100 | PV Fast Red E5B | Clariant |
| Magenta pigment 3 | Violet 19 | 230 | Hostaperm Red E2B70 | Clariant |
| Magenta pigment 4 | Red 122 | 65 | Hostaperm Pink E02 | Clariant |
| Magenta pigment 5 | 57:1 | 115 | Toner Magenta 6B | Clariant |
| Cyan pigment 1 | Blue 15:3 | 61 | Blue B2G | Clariant |
| Cyan pigment 2 | Blue 15:1 | 50 | Hostaperm Blue A2R | Clariant |
| Cyan pigment 3 | Blue 15:2 | 110 | Hostaperm Blue AFL | Clariant |
| Cyan pigment 4 | Blue 15:4 | 60 | IRGALITE BLUE GLVO | Chiba Geigy |
| Yellow pigment 1 | Yellow 180 | 130 | Toner Yellow HG | Clariant |
| Yellow pigment 2 | Yellow 185 | 61 | Paliotol Yellow D1155 | BASF |
| Yellow pigment 3 | Yellow 74 | 65 | Hansa Brilliant Yellow 5GX03 | Clariant |
| Yellow pigment 4 | Yellow 155 | 47 | Toner Yellow 3GP | Clariant |

(Volume Average Particle Diameter ($D_{50}$) μm of Toner) "The volume average particle diameter ($D_{50}$) of each of the color toners (magenta toners 1 to 4 and 6 to 15, cyan toners 1 to 4 and 6 to 9, and yellow toners . . . COULTER COUNTER TA-II model (manufactured by Coulter Inc.) in the following manner."

The volume average particle diameter ($D_{50}$) of each of the color toners (magenta toners 1 to 4 and 6 to 15, cyan toners 1 to 4 and 6 to 9, and yellow toners 1 to 4 and 6 to 9) were determined in micrometer by means of a measuring device of COULTER COUNTER TA-II model (manufactured by Coulter Inc.) in the following manner. Namely, first, an interface (manufactured by Nikkaki Co., Ltd.,) for outputting the volume average particle diameter and a CX- 1 personal computer (manufactured by Canon Co., Ltd.,) were connected. Then, an electrolytic aqueous solution of 1 % NaCl aqueous solution was prepared using primary sodium chloride. In 100 to 150 ml of the electrolytic aqueous solution, a surfactant (preferably, alkylbenzene sulfonate) was added in an amount of 0.1 to 5 ml as a dispersant. Further, a test sample was added in an amount of 0.5 to 50 mg thereto. The electrolytic aqueous solution containing the sample in suspension was subjected to a dispersion treatment for about 1 to 3 minutes by means of an ultrasonic dispersing device. Then, the particle distribution of 2.00 to 50-μm particles was determined by the COULTER COUNTER Model TA-II using a 100-μm aperture to determine the volume average particle diameter ($D_{50}$) in micrometer.

Forming of an Image

By using each of the resulting color toners as a one-component developer, an image was formed on plain paper (NIP-1500LT, manufactured by Kobayashi Kirokushi Co., Ltd.,) by means of a GL8300 printer (Fujitsu Limited) with the structure schematically shown in FIG. 1.

Figure 2:
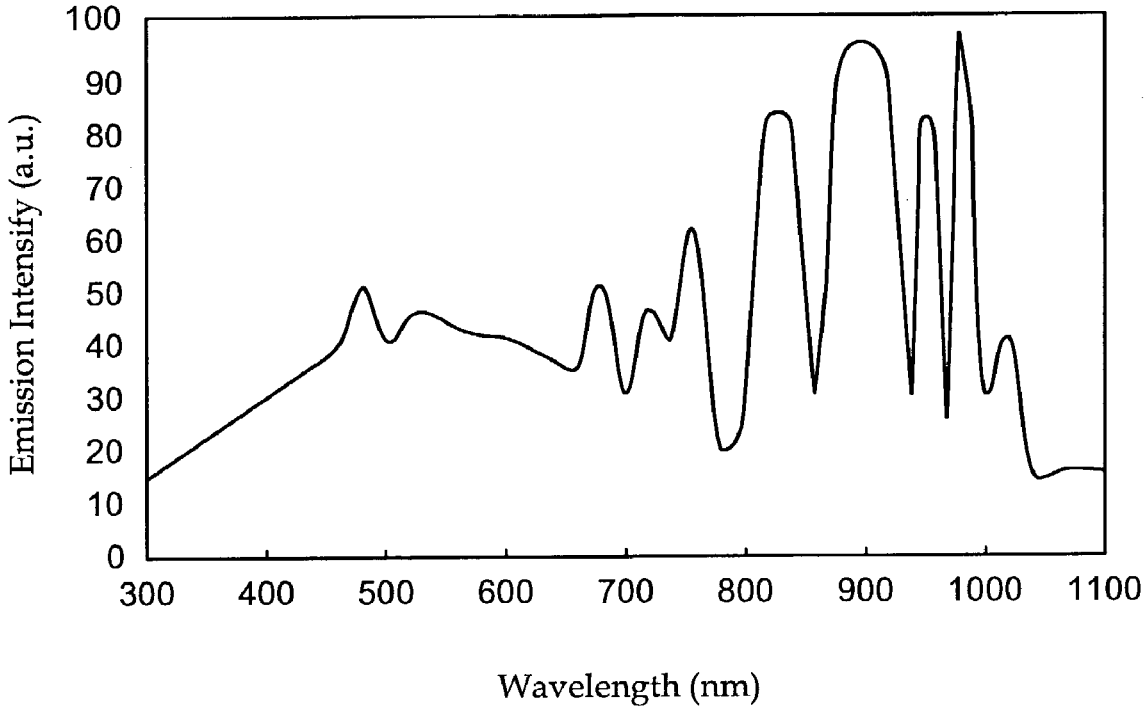
FIG. 2 is a graph showing the light emission waveform of a flash fixing unit.

Incidentally, as the means for flash fixing 80 in the apparatus for forming a color image 100 schematically shown in FIG. 1, there was used a flash (flash lamp) fixing device in a flash printer PS2160 (manufactured by Fujitsu Limited). Further, the light emission waveform of the flash (flash lamp) fixing device is shown in FIG. 2. The optical energy of the flash (flash lamp) fixing device was found to be 3.5 J/cm$^2$.

(Fixability Evaluation (Tape Peeling Test))

The image status A concentration on plain paper on which each of the images was formed was determined. Then, a peel able tape (trade name "SCOTCH MENDING TAPE" (manufactured by Sumitomo 3M Co., Ltd.)) was adhered onto the toner image on plain paper. Then, the peel able tape was peeled off to determine the status concentration on plain paper after peeling again. Thus, the image printing concentration (%) on plain paper after peeling was defined as the toner fixing ratio when the image printing concentration on plain paper before peeling off the peel able tape was set to be 100. Thus, evaluation was carried out in accordance with the following evaluation criteria. It is noted that a spectrometer (938 SPECTRODENTITOMETER (manufactured by X-Rite Co.)) was used for determining the status concentration. In the following evaluation criteria, the practical level is 80 % or more. The results are shown in Tables 3 to 7.

When the fixing ratio is less than 70% . . . x

When the fixing ratio is 70% or more, and less than 80% . . . Δ

When the fixing ratio is 80% or more . . . ○

(Evaluation of Void)

Each of the resulting images was observed under an optical microscope, and evaluated according to the following evaluation criteria. The results are shown in Tables 3 to 7.

When occurrence of voids is apparently observed . . . x

When a few voids are observed under the standard conditions (the amount of toner deposited is 0.6 mg/cm$^2$), but they cannot be observed visually . . . Δ

When no void is observed under the standard conditions (the amount of toner deposited is 0.6 mg/cm$^2$) . . . ○

When no void is observed even if the amount of toner deposited is 0.9 mg/cm$^2$ or more . . . . ◎

(Evaluation of Color Tone)

As for each of the images formed in the foregoing manner on the plain paper, the "L", "a*", and "b*" values after fixing were determined by means of a spectrometer (938 SPECTRODENTITOMETER (manufactured by X-Rite Co.)). The case satisfying the following expression (1) was evaluated as "O". The results are shown in Tables 3 to 7.

TABLE 3

| | Name | Magenta toner 1 | Magenta toner 2 | Magenta toner 3 | Magenta toner 4 | Magenta toner 6 |
|---|---|---|---|---|---|---|
| Magenta pigment 1 | Hostaperm Red E5B02 | 5 | 5 | 5 | 5 | 5 |

TABLE 3-continued

| | Name | Magenta toner 1 | Magenta toner 2 | Magenta toner 3 | Magenta toner 4 | Magenta toner 6 |
|---|---|---|---|---|---|---|
| Binder resin | Binder resin 1 | 92 | — | — | — | — |
| | Binder resin 2 | — | 92 | — | — | — |
| | Binder resin 3 | — | — | 92 | — | — |
| | Binder resin 4 | — | — | — | 92 | — |
| | Binder resin 6 | — | — | — | — | 92 |
| Charge control agent | N4P (Clariant) | 1 | 1 | 1 | 1 | 1 |
| Infrared absorbent | YKR-5010 | 1 | 1 | 1 | 1 | 1 |
| Wax | Wax 1 | 1 | 1 | 1 | 1 | 1 |
| Volume average particle diameter ($D_{50}$) in μm of toner | | 8.3 | 8.4 | 8.3 | 8.3 | 8.4 |
| Fixability | | ○ | ○ | ○ | x | x |
| Void resistance | | x | ○ | ○ | ○ | ○ |
| Color tone | | ○ | ○ | ○ | ○ | ○ |

TABLE 4

| | Name | Cyan toner 1 | Cyan toner 2 | Cyan toner 3 | Cyan toner 4 | Cyan toner 6 |
|---|---|---|---|---|---|---|
| Cyan pigment 1 | Blue B2G | 5 | 5 | 5 | 5 | 5 |
| Binder resin | Binder resin 1 | 92 | — | — | — | — |
| | Binder resin 2 | — | 92 | — | — | — |
| | Binder resin 3 | — | — | 92 | — | — |
| | Binder resin 4 | — | — | — | 92 | — |
| | Binder resin 6 | — | — | — | — | 92 |
| Charge control agent | N4P (Clariant) | 1 | 1 | 1 | 1 | 1 |
| Infrared absorbent | YKR-5010 | 1 | 1 | 1 | 1 | 1 |
| Wax | Wax 1 | 1 | 1 | 1 | 1 | 1 |
| Volume average particle diameter ($D_{50}$) in μm | | 8.4 | 8.3 | 8.3 | 8.4 | 8.3 |
| Fixability | | ○ | ○ | ○ | ○ | x |
| Void resistance | | x | x | x | ○ | ○ |
| Color tone | | ○ | ○ | ○ | ○ | ○ |

TABLE 5

| | Name | Yellow toner 1 | Yellow toner 2 | Yellow toner 3 | Yellow toner 4 | Yellow toner 6 |
|---|---|---|---|---|---|---|
| Yellow pigment 1 | Toner Yellow HG | 5 | 5 | 5 | 5 | 5 |
| Binder resin | Binder resin 1 | 92 | — | — | — | — |
| | Binder resin 2 | — | 92 | — | — | — |
| | Binder resin 3 | — | — | 92 | — | — |
| | Binder resin 4 | — | — | — | 92 | — |
| | Binder resin 6 | — | — | — | — | 92 |
| Charge control agent | N4P (Clariant) | 1 | 1 | 1 | 1 | 1 |
| Infrared absorbent | YKR-5010 | 1 | 1 | 1 | 1 | 1 |
| Wax | Wax 1 | 1 | 1 | 1 | 1 | 1 |
| Volume average particle diameter ($D_{50}$) in μm | | 8.3 | 8.4 | 8.3 | 8.4 | 8.3 |
| Fixability | | ○ | ○ | ○ | ○ | x |
| Void resistance | | x | x | x | ○ | ○ |
| Color tone | | ○ | ○ | ○ | ○ | ○ |

TABLE 6

| | Name | Magenta toner 7 | Magenta toner 8 | Magenta toner 9 | Magenta toner 10 | Magenta toner 11 | Magenta toner 12 | Magenta toner 13 | Magenta toner 14 | Magenta toner 15 |
|---|---|---|---|---|---|---|---|---|---|---|
| Magenta pigment 1 | Hostaperm Red E5B02 | — | — | 5 | 5 | 5 | 5 | 5 | — | — |
| Magenta pigment 2 | PV Fast Red E5B | — | — | — | — | — | — | — | 5 | — |
| Magenta pigment 4 | Hostaperm Pink E02 | 5 | — | — | — | — | — | — | — | 5 |
| Magenta pigment 5 | Toner Magenta 6B | | 5 | — | — | — | — | — | — | 5 |
| Binder resin | Binder resin 4 | 92 | 92 | 92 | 92 | 92 | 92 | 92 | 92 | 92 |
| Charge control agent | N4P ((Clariant)) | 1 | 1 | 1 | 1 | 1 | 1 | 1 | 1 | 1 |
| Infrared absorbent | YKR-5010 | 1 | 1 | 1 | 1 | 1 | 1.2 | 1 | 1 | 1 |

TABLE 6-continued

| Name | | Magenta toner 7 | Magenta toner 8 | Magenta toner 9 | Magenta toner 10 | Magenta toner 11 | Magenta toner 12 | Magenta toner 13 | Magenta toner 14 | Magenta toner 15 |
|---|---|---|---|---|---|---|---|---|---|---|
| Wax | Wax 1 | 1 | 1 | 1 | 1 | 1 | 1 | 2 | 1 | 1 |
| Volume average particle diameter ($D_{50}$) in μm | | 8.3 | 8.4 | 7.3 | 7.7 | 8.9 | 8.4 | 8.4 | 8.4 | 8.3 |
| Fixability | | ○ | ○ | ○ | ○ | x | ○ | ○ | x | ○ |
| Void resistance | | ○ | ○ | ○ | ○ | ○ | ○ | ○ | ○ | ○ |
| Color tone | | x | ○ | ○ | ○ | ○ | ○ | ○ | ○ | ○ |

TABLE 7

| Name | | Cyan toner 7 | Cyan toner 8 | Cyan toner 9 | Yellow toner 7 | Yellow toner 8 | Yellow toner 9 |
|---|---|---|---|---|---|---|---|
| Cyan pigment 2 | Hostaperm Blue A2R | 5 | — | — | — | — | — |
| Cyan pigment 3 | Hostaperm Blue AFL | — | 5 | — | — | — | — |
| Cyan pigment 4 | IRGALITE BLUE GLVO | — | — | 5 | — | — | — |
| Yellow pigment 2 | Yellow 185 | — | — | — | 5 | — | — |
| Yellow pigment 3 | Yellow 74 | — | — | — | — | 5 | — |
| Yellow pigment 4 | Yellow 155 | — | — | — | — | — | 5 |
| Binder resin | Binder resin 4 | 92 | 92 | 92 | 92 | 92 | 92 |
| Charge control agent | N4P (Clariant) | 1 | 1 | 1 | 1 | 1 | 1 |
| Infrared absorbent | YKR-5010 | 1 | 1 | 1 | 1 | 1 | 1 |
| Wax | Wax 1 | 1 | 1 | 1 | 1 | 1 | 1 |
| Volume average particle diameter ($D_{50}$) in μm | | 8.4 | 8.4 | 8.4 | 8.4 | 8.4 | 8.4 |
| Fixability | | ○ | ○ | ○ | ○ | ○ | ○ |
| Void resistance | | ○ | ○ | ○ | ○ | ○ | ○ |
| Color tone | | ○ | x | x | ○ | ○ | x |

The results shown in Tables 3 to 5 indicate as follow. Namely, the image of the magenta toner exhibits more excellent fixability and void resistance when using a binder resin (binder resin 2 or 3) with a higher storage modulus (100° C.) (i.e., with a lower viscosity) as the binder resin included therein as compared with the images of the cyan toner and the yellow toner.

The results of Tables 6 and 7 have shown that the respective images of the magenta toners 7 and 8 each using a typical magenta pigment are excellent in fixability and void resistance, but inferior in color tone. Further, for each of the magenta toners 9 to 11 which are smaller in volume average particle diameter ($D_{50}$) than the cyan toners 7 to 9 and the yellow toner 7 to 9 by 0.5 μm or more, all of the fixability, the void resistance, and the color tone have been found to be excellent. Still further, for each of the magenta toners 12 and 13 which are larger in contents of the infrared absorbent and the wax than the cyan toners 7 to 9 and the yellow toners 7 to 9, all of the fixability, the void resistance, and the color tone have been found to be excellent. Furthermore, for the image of the magenta toner 15 in which the pigment has a particle diameter (primary average particle diameter (nm)) 1.5 times or more that of the pigment in the yellow toner or the cyan toner, all of the fixability, the void resistance, and the color tone have been found to be excellent.

(Experiment)

By using the yellow toner 4, the cyan toner 4, and the magenta toner 15, obtained in examples and comparative examples, each relationship between the fixability and the void resistance was evaluated by changing the flash energy. As a result, at 1.5 J/cm$^2$, when toners of 3 or more layers are stacked, they are fixed poorly. At 2.0 J/cm$^2$, the fixability is 90% which is on a problem-free level. At 5 J/cm$^2$, the color toners for electrophotography of all the colors exhibit sufficient performances in both void resistance and fixability. At 7 J/cm$^2$, some voids are observed in the color toners for electrophotography of all the colors.

Incidentally, in each of Tables 3 to 7, a naphthalocyanine compound (manufactured by Yamamoto Chemicals Inc.; maximum absorption wavelength=880 nm, color tone: green) is used as the infrared absorbent (YKR-5010). The wax 1 used is WEP-5F manufactured by NOF Corp.

In accordance with the present invention, it is possible to provide a color toner for electrophotography, which is capable of meeting the foregoing requirements, and solving the various conventional problems, is excellent in fixability and void resistance, and is capable of forming a high-quality image, and a color toner set for electrophotography using the same, a color developer for electrophotography, a method for forming a color image, and an apparatus for forming a color image.

What is claimed is:

1. A magenta toner for electrophotography, comprising:

a binder resin having a storage modulus ($G'_{100}$) (100° C.) of $9.0\times10^3$ to $4.0\times10^4$ dyn/cm$^2$; and C.I. pigment Violet 19 wherein said binder resin is the only binder resin within the magenta toner.

2. A color toner set for electrophotography, comprising:

a magenta toner which comprises a binder resin; and at least any of a yellow toner and a cyan toner, the color toner set being used for forming a multicolor image, wherein the binder resin in the magenta toner has a storage modulus ($G'_{100}$) (100° C.) of (1/1.1) to (1/10) times a storage modulus ($G'_{100}$) (100° C.) of a binder resin contained in the yellow toner and the cyan toner.

3. The color toner set for electrophotography according to claim 2, wherein the magenta toner comprises C.I. pigment Violet 19.

4. A color toner set for electrophotography, comprising:

a magenta toner which comprises a binder resin having a storage modulus ($G'_{100}$) (100° C.) of $9.0\times10^3$ to $4.0\times10^4$ dyn/cm$^2$, and C.I. pigment Violet 19; and at least any of a yellow toner and a cyan toner each containing a binder resin having a storage modulus ($G'_{100}$) (100° C.) of $4.4\times10^4$ to $8.0\times10^5$ dyn/cm$^2$, the color toner set being used for forming a multicolor image.

5. A color toner set for electrophotography, comprising:

a magenta toner which comprises a binder resin, and C.I. pigment Violet 19;

a yellow toner and a cyan toner, the color toner set being used for forming a multicolor image, wherein the magenta toner contains a pigment having a particle diameter (primary average particle diameter (nm)) of 1.5 times or more a particle diameter (primary average particle diameter (nm)) of a pigment contained in the yellow toner and the cyan toner.

6. A color toner set for electrophotography, comprising:

a magenta toner which comprises a binder resin, C.I. pigment Violet 19, and an infrared absorbent;

a yellow toner and a cyan toner, the color toner set being used for forming a multicolor image, wherein the magenta toner has a content of an infrared absorbent higher than a content of an infrared absorbent in each of the yellow toner and the cyan toner.

7. A color toner set for electrophotography, comprising:

a magenta toner which comprises a binder resin, C.I. pigment Violet 19, and waxes;

a yellow toner and a cyan toner, the color toner set being used for forming a multicolor image, wherein the magenta toner has a content of the waxes higher than a content of waxes in each of the yellow toner and the cyan toner.

8. An apparatus for forming a color image, comprising:

a color toner set for electrophotography;

an electrostatic latent image carrier;

means for forming an electrostatic latent image on the electrostatic latent image carrier;

means for developing the electrostatic latent image using the color toner set for electrophotography, and forming a visible image, wherein the means for developing comprises the color toner set for electrophotography;

means for transferring the visible image onto a recording medium; and means for flash fixing a transfer image transferred onto the recording medium, wherein the color toner set for electrophotography comprises:

a magenta toner which comprises a binder resin; and at least any of a yellow toner and a cyan toner, the color toner set being used for forming a multicolor image, wherein the binder resin in the magenta toner has a storage modulus ($G'_{100}$) (100° C.) of (1/1.1) to (1/10) times a storage modulus ($G'_{100}$) (100° C.) of a binder resin contained in the yellow toner and the cyan toner.

9. An apparatus for forming a color image according to claim 8, wherein an optical energy during flash fixing by the means for flash fixing is 2 to 7 J/cm$^2$.

10. An apparatus for forming a color image, comprising:

a color toner set for electrophotography;

an electrostatic latent image carrier;

means for forming an electrostatic latent image on the electrostatic latent image carrier;

means for developing the electrostatic latent image using the color toner set for electrophotography, and forming a visible image, wherein the means for developing comprises the color toner set for electrophotography;

means for transferring the visible image onto a recording medium; and means for flash fixing a transfer image formed by the visible image being transferred onto the recording medium, the color toner set for electrophotography, comprises:

a magenta toner which comprises a binder resin having a storage modulus ($G'_{100}$) (100° C.) of $9.0\times10^3$ to $4.0\times10^4$ dyn/cm$^2$; and C.I. pigment Violet 19; and at least any of a yellow toner and a cyan toner each containing a binder resin with a storage modulus ($G'_{100}$) (100° C.) of $4.4\times10^4$ to $8.0\times10^5$ dyn/cm$^2$, the color toner set being used for forming a multicolor image.

11. An apparatus for forming a color image, comprising:

a color toner set for electrophotography;

an electrostatic latent image carrier;

means for forming an electrostatic latent image on the electrostatic latent image carrier;

means for developing the electrostatic latent image using the color toner set for electrophotography, and forming a visible image, wherein the means for developing comprises the color toner set for electrophotography;

means for transferring the visible image onto a recording medium; and means for flash fixing a transfer image formed by the visible image being transferred onto the recording medium, wherein the color toner set for electrophotography comprises:

a magenta toner which comprises a binder resin, and C.I. pigment Violet 19;

a yellow toner and a cyan toner, the color toner set being used for forming a multicolor image, wherein the magenta toner contains a pigment having a particle diameter (primary average particle diameter (nm)) 1.5 times or more a particle diameter (primary average particle diameter (nm)) of a pigment contained in the yellow toner and the cyan toner.

12. An apparatus for forming a color image, comprising:

a color toner set for electrophotography;

an electrostatic latent image carrier;

means for forming an electrostatic latent image on the electrostatic latent image carrier;

means for developing the electrostatic latent image using the color toner set for electrophotography, and forming a visible image, wherein the means for developing comprises the color toner set for electrophotography;

means for transferring the visible image onto a recording medium; and means for flash fixing a transfer image formed by the visible image transferred onto the recording medium, wherein the color toner set for electrophotography comprises:

a magenta toner which comprises a binder resin, C.I. pigment Violet 19, and an infrared absorbent;

a yellow toner and a cyan toner, the color toner set being used for forming a multicolor image, wherein the magenta toner has a content of an infrared absorbent higher than a content of an infrared absorbent in each of the yellow toner and the cyan toner.

13. An apparatus for forming a color image, comprising:

a color toner set for electrophotography;

an electrostatic latent image carrier;

means for forming an electrostatic latent image on the electrostatic latent image carrier;

means for developing the electrostatic latent image using a color toner set for electrophotography, and forming a visible image, wherein the means for developing comprises the color toner set for electrophotography;

means for transferring the visible image onto a recording medium; and means for flash fixing a transfer image transferred onto the recording medium, wherein the color toner set for electrophotography comprises:

a magenta toner which comprises a binder resin, C.I. pigment Violet 19, and waxes;

a yellow toner and a cyan toner, the color toner set being used for forming a multicolor image, wherein the magenta toner has a content of the waxes higher than a content of waxes in each of the yellow toner and the cyan toner.

* * * * *